US005176815A

United States Patent [19]

Lomas

[11] Patent Number: 5,176,815

[45] Date of Patent: Jan. 5, 1993

[54] FCC PROCESS WITH SECONDARY CONVERSION ZONE

[75] Inventor: David A. Lomas, Arlington Heights, Ill.

[73] Assignee: UOP, Des Plaines, Ill.

[21] Appl. No.: 632,794

[22] Filed: Dec. 17, 1990

[51] Int. Cl.[5] ..... C10G 51/06

[52] U.S. Cl. ..... 208/78; 208/113; 208/148; 208/151; 208/153; 208/155; 208/164; 208/163

[58] Field of Search ..... 208/153, 164, 155, 148, 208/141, 163, 74, 78, 113

[56] References Cited

U.S. PATENT DOCUMENTS

| | | | |
|---|---|---|---|
| 2,420,145 | 5/1947 | McAfee | 208/155 |
| 2,550,290 | 4/1951 | Pelzer et al. | 208/74 |
| 2,698,281 | 12/1954 | Leffer | 208/155 |
| 2,785,110 | 3/1957 | Leffer | 208/148 |
| 2,883,332 | 4/1959 | Wickham | 208/148 |
| 2,915,457 | 12/1959 | Abbott et al. | 208/74 |
| 2,921,014 | 1/1960 | Marshall | 208/74 |
| 2,956,003 | 10/1960 | Marshall | 208/74 |
| 3,063,932 | 11/1962 | Osborne | 208/74 |
| 3,123,547 | 3/1964 | Palmer et al. | 208/155 |
| 3,161,582 | 12/1964 | Wickham | 208/164 |
| 3,288,878 | 11/1966 | Hackmuth | 208/164 |
| 3,305,475 | 2/1967 | Waldby et al. | 208/164 |
| 3,607,129 | 9/1971 | Carson | 208/155 |
| 3,661,800 | 5/1972 | Pfeiffer | 208/155 |
| 3,677,715 | 7/1972 | Morrison et al. | 208/155 |
| 3,732,081 | 5/1973 | Carson | 208/155 |
| 4,295,961 | 10/1981 | Fahrig et al. | 208/161 |
| 4,390,503 | 6/1983 | Walters et al. | 422/147 |
| 4,419,221 | 12/1983 | Castagnos, Jr. et al. | 208/164 |
| 4,422,925 | 12/1983 | Williams et al. | 208/164 |
| 4,436,613 | 3/1984 | Sayles et al. | 208/155 |
| 4,464,250 | 8/1984 | Myers et al. | 208/120 |
| 4,479,870 | 10/1984 | Hammershaimb et al. | 208/164 |
| 4,624,771 | 11/1986 | Lane et al. | 208/74 |
| 4,624,772 | 11/1986 | Krambeck et al. | 208/95 |
| 4,664,888 | 5/1987 | Castagnos, Jr. | 422/147 |
| 4,737,346 | 4/1988 | Haddad et al. | 422/144 |
| 4,789,458 | 12/1988 | Haddad et al. | 208/151 |
| 4,792,437 | 12/1988 | Hettinger, Jr. et al. | 422/147 |
| 4,793,915 | 12/1988 | Haddad et al. | 208/161 |
| 4,814,068 | 3/1989 | Herbst et al. | 208/155 |
| 4,868,144 | 9/1989 | Herbst et al. | 208/164 |
| 4,874,503 | 10/1989 | Herbst et al. | 208/155 |
| 4,966,681 | 10/1990 | Herbst et al. | 208/155 |

*Primary Examiner*—Helane Myers

*Attorney, Agent, or Firm*—Thomas K. McBride; John G. Tolomei

[57] ABSTRACT

An FCC process uses an open reactor vessel to house cyclones or other separation devices that reduce the carry though of product gases with the catalyst into the reactor vessel to less than 5 wt. % so that the catalyst in the reactor vessel can contact a secondary feedstock. By using a highly efficient separation device to remove product from the catalyst the environment in the reactor vessel receives a low volume of feed hydrocarbons and riser by-products. These by products comprise mainly $C_2$ and lighter gases which are inert to a variety of other feedstreams. Possible secondary feedstreams include hydrotreated heavy naphtha, hydrotreated light cycle oil, light reformate and olefins. It is highly useful to use the secondary feedstream to heat the catalyst in the reactor vessel to facilitate hot stripping of the catalyst. Heat may be introduced in this manner by heating the secondary feedstream or using a feedstream that produces an exothermic reaction in the reactor vessel.

21 Claims, 2 Drawing Sheets

Fig. 2
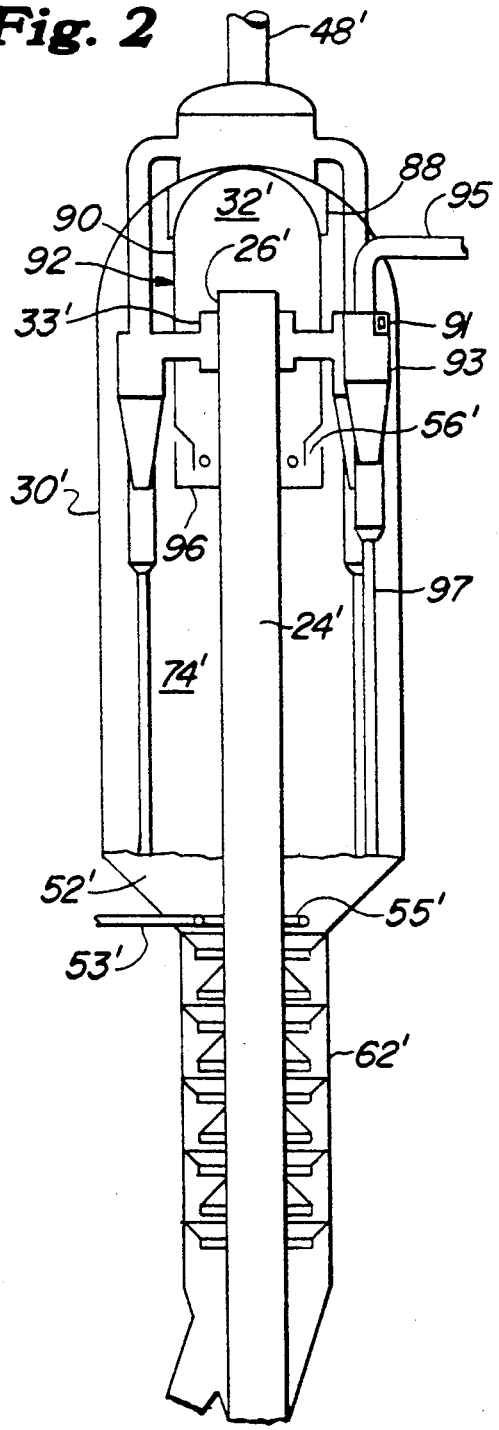
Fig. 3
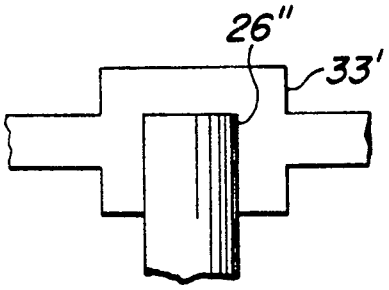
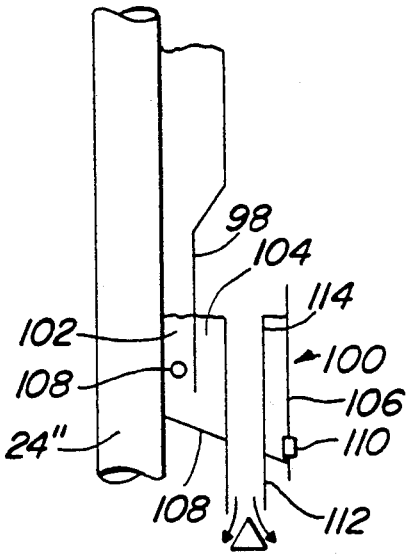
Fig. 4

FCC PROCESS WITH SECONDARY CONVERSION ZONE

FIELD OF THE INVENTION

This invention relates generally to processes for the fluidized catalytic cracking (FCC) of heavy hydrocarbon streams such as vacuum gas oil and reduced crudes. This invention relates more specifically to a method for reacting hydrocarbons in an FCC reactor and separating reaction products from the catalyst used therein.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment of apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium.

The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. During the cracking reaction, coke will be deposited on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

One improvement to FCC units, that has reduced the product loss by thermal cracking and undesirable secondary catalytic cracking, is the use of riser cracking. In riser cracking, regenerated catalyst and starting materials enter a pipe reactor and are transported upward by the expansion of the gases that result from the vaporization of the hydrocarbons, and other fluidizing mediums if present, upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser designs use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

The benefits of using lift gas to pre-accelerate and condition regenerated catalyst in a riser type conversion zone are well known. Lift gas typically has a low concentration of heavy hydrocarbons, i.e. hydrocarbons having a molecular weight of $C_3$ or greater are avoided. In particular, highly reactive type species such as $C_3$ plus olefins are unsuitable for lift gas. Thus, lift gas streams comprising steam and light hydrocarbons are generally used.

Riser cracking whether with or without the use of lift gas has provided substantial benefits to the operation of the FCC unit. These can be summarized as a short contact time in the reactor riser to control the degree of cracking that takes place in the riser and improved mixing to give a more homogeneous mixture of catalyst and feed. A more complete distribution prevents different times for the contact between the catalyst and feed over the cross-section of the riser such that some of the feed contacts the catalyst for a longer time than other portions of the feed. Both the short contact time and a more uniform average contact time for all of the feed with the catalyst has allowed overcracking to be controlled or eliminated in the reactor riser.

Unfortunately, much of what can be accomplished in the reactor riser in terms of uniformity of feed contact and controlled contact time can be lost when the catalyst is separated from the hydrocarbon vapors. As the catalyst and hydrocarbons are discharged from the riser, they must be separated. In early riser cracking operations, the output from the riser was discharged into a large vessel. This vessel serves as a disengaging chamber and is still referred to as a reactor vessel, although most of the reaction takes place in the reactor riser. The reactor vessel has a large volume. Vapors that enter the reactor vessel are well mixed in the large volume and therefore have a wide residence time distribution that results in relatively long residence times for a significant portion of the product fraction. Product fractions that encounter extended residence times can undergo additional catalytic and thermal cracking to less desirable lower molecular weight products.

In an effort to further control the contact time between catalyst and feed vapors, there has been continued investigation into the use of cyclones that are directly coupled to the end of the reactor riser. This direct coupling of cyclones to the riser provides a quick separation of a large portion of the product vapors from the catalyst. Therefore, contact time for a large portion of the feed vapors can be closely controlled. One problem with directly coupling cyclones to the outlet of the reactor riser is the need for a system that can handle pressure surges from the riser. These pressure surges and the resulting transient increase in catalyst loading inside the cyclones can overload the cyclones such that an unacceptable amount of fine catalyst particles are carried over with the reactor vapor into downstream separation facilities. Therefore, a number of apparatus arrangements have been proposed for direct coupled cyclones that significantly complicate the arrangement and apparatus for the direct coupled cyclones, and either provide an arrangement where a significant amount of reactor vapor can enter the open volume of the reactor/vessel or compromise the satisfactory operation of the cyclone system by subjecting it to the possibility of temporary catalyst overloads.

Aside from the operational problems of close coupled cyclones, such cyclones have an upper limit on the amount of product gases that they will carry through with the separated catalyst into the reactor vessel. As the catalyst flows from location to location it always has a certain amount of void space. Two types of void space make-up the total catalyst voidage, interstitial voidage which comprises the space between catalyst particles and skeletal void spaces that comprise the internal pore volume of the catalyst. In the direct connected cyclone schemes all of the catalyst from the riser enters the cyclones and fall into the reactor vessel. Product vapors from the riser fill all the void spaces of the catalyst leaving the cyclones. For a relatively dense catalyst bed this total voidage will contain at least 7 wt. % of the riser product. Therefore, direct connected cyclones can still carry a relatively large percentage of riser products into the reactor vessel. Thus, although direct coupled cyclone systems can help to control contact time between catalyst and feed vapors, they will not completely eliminate the presence of hydrocarbon vapors in the open space of a reactor vessel.

No matter what separation system is used, product vapors are still present in the open volume of the reactor vessel from the stripped hydrocarbon vapors that are removed from the catalyst and pass upwardly into the open space above the stripping zone. The amount of hydrocarbon vapors is also increased by direct coupled cyclone arrangements that allow feed vapors to enter the open space that houses the cyclones. Since the dilute phase volume of the reactor vessel remains unchanged when direct connected cyclones are used and less hydrocarbon vapors enter the dilute phase volume from the riser, the hydrocarbon vapors that do enter the dilute phase volume will be there for much longer periods of time. (The terms "dense phase" and "dilute phase" catalysts as used in this application are meant to refer to the density of the catalyst in a particular zone. The term "dilute phase" generally refers to a catalyst density of less than 20 lbs/ft$^2$ and the term "dense phase" refers to catalyst densities above 20 lbs/ft$^2$. Catalyst densities in the range of 20 to 30 lbs/ft$^2$ can be considered either dense or dilute depending on the density of the catalyst in adjacent zones or regions but for the purposes of this description are generally considered to mean dense.) In other words, when a direct connected cyclone system is used, less product vapors may enter the open space of the reactor vessel, but these vapors will have a much longer residence time in the reactor vessel. As a result, any feed and intermediate product components left in the reactor vessel are substantially lost to overcracking.

A different apparatus that has been known to promote quick separation between the catalyst and the vapors in the reactor vessels is known as a ballistic separation device which is also referred to as a vented riser. The structure of the vented riser in its basic form consists of a straight portion of conduit at the end of the riser and an opening that is directed upwardly into the reactor vessel with a number of cyclone inlets surrounding the outer periphery of the riser near the open end. The apparatus functions by shooting the high momentum catalyst particles past the open end of the riser where the gas collection takes place. A quick separation between the gas and the vapors occurs due to the relatively low density of the gas which can quickly change directions and turn to enter the inlets near the periphery of the riser while the heavier catalyst particles continue along a straight trajectory that is imparted by the straight section of riser conduit. The vented riser has the advantage of eliminating any dead area in the reactor vessel where coke can form while providing a quick separation between the catalyst and the vapors. However, the vented riser still has the drawback of operating within a large open volume in the reactor vessel.

DISCLOSURE STATEMENT

U.S. Pat. Nos. 4,390,503 and 4,792,437 disclose ballistic separation devices.

U.S. Pat. No. 4,295,961 shows the end of a reactor riser that discharges into a reactor vessel and an enclosure around the riser that is located within the reactor vessel.

U.S. Pat. No. 4,737,346 shows a closed cyclone system for collecting the catalyst and vapor discharge from the end of a riser.

U.S. Pat. No. 4,624,772 shows a closed cyclone system that uses vent doors in gas ducts between the cyclones to relieve pressure surges.

U.S. Pat. No. 4,624,771, issued to Lane et al. on Nov. 25, 1986, discloses a riser cracking zone that uses fluidizing gas to pre-accelerate the catalyst, a first feed introduction point for injecting the starting material into the flowing catalyst stream, and a second downstream fluid injection point to add a quench medium to the flowing stream of starting material and catalyst.

U.S. Pat. No. 4,624,772 issued to Krambeck et al., discloses a closed coupled cyclone system that has vent openings, for relieving pressure surges, that are covered with weighted flapper doors so that the openings are substantially closed during normal operation.

U.S. Pat. No. 4,664,888 issued to Castagnos and U.S. Pat. No. 4,793,915 issued to Haddad et. al., show baffle arrangements at the end of an upwardly discharging riser. The 915' patent shows the introduction of steam into the baffle arrangement for stripping catalyst that flows downward from the riser.

U.S. Pat. No. 4,479,870 issued to Hammershaimb et al., teaches the use of lift gas having a specific composition in a riser zone at a specific set of flowing conditions with the subsequent introduction of the hydrocarbon feed into the flowing catalyst and lift gas stream.

U.S. Pat. No. 4,464,250, issued to Maiers et al. and U.S. Pat. No. 4,789,458, issued to Haddad et al. teach the heating of spent catalyst particles to increase the removal of hydrocarbons, hydrogen and/or carbon from the surface of spent catalyst particles by heating the catalyst particles after initial stripping of hydrocarbons in the stripping zone of an FCC unit.

PROBLEMS PRESENTED BY PRIOR ART

One problem faced by the prior art is the need to obtain a quick separation between catalyst and product vapors leaving an FCC riser in a system that minimizes overcracking of product vapors and the carryover of fine catalyst particles with the product vapors. The vented riser or ballistic separation device can provide a quick separation between catalyst particles and reactor vapors. However, the use of this type of device or other separation means at the end of the riser retains reentrains potential product in the open volume of the reactor where overcracking occurs.

Another problem is the loss of a significant portion of the product that the separated catalyst carries into the reactor vessel and stripper. When using a cyclone arrangement for separating a majority of the catalyst product, vapors fill the void volume of the catalyst. As the cyclones recover catalyst they transfer the catalyst together with products contained in the void volume into the reactor vessel and stripper. Product vapors that the catalyst carries into the reactor vessel and stripper are essentially lost to overcracking due to the long contact time therein. Accordingly, the more catalyst that the cyclones recover the more product vapors that are carried into the reactor vessel. The use of direct connected cyclone systems exacerbate the problem since the cyclones recover essentially all of the catalyst from the riser and the entire void fraction associated with the large volume of recovered catalyst carries product into the reactor vessel. Thus, direct connected cyclones increases this secondary loss of product to overcracking. Moreover the resulting gases are very light, have little product value and increase the gas traffic in FCC recovery facilities.

Finally, in most FCC units the reactor vessel is relatively large, but only serves the primary purpose of housing the cyclones. It would be highly desirable to find an additional use for the reactor vessel.

BRIEF DESCRIPTION OF THE INVENTION

It is an object of this invention to improve processes and apparatus for reducing the hydrocarbon residence time in a reactor vessel.

It is another object of this invention to make better use of the reactor vessel that houses the cyclones or other separation device.

A further object of this invention is to decrease the gas traffic in the separation facilities that receive an FCC product stream.

This invention is an FCC process having a reactor/-riser that discharges catalyst and a vapor separation device at the end of a riser which obtains a very high initial separation of catalyst from gas that exits the riser and effects a very low transfer of riser vapors into the reactor vessel so that the reactor vessel can be used to treat a secondary feed and permit the independent recovery of all vapors or gases from the reactor vessel.

The dramatically different modes of operation in the reactor riser and the reactor vessel offer distinctly different processing zones in the same apparatus. The riser and enclosed separation system can provide a short contact time and limited catalyst to hydrocarbon ratios for reactants passing therethrough. Conversely, reactants in the reactor vessel can have a relatively long catalyst contact time and a high catalyst to hydrocarbon ratio. Thus, the short contact time riser conditions favor monomolecular reactions whereas, the longer contact times in the reactor vessel favor bimolecular reactions. The process can be arranged such that all of the reactants are recovered together from the reactor or with independent recovery of riser products and reactor vessel products.

By obtaining a very high initial separation of catalyst and riser gaseous products the overcracking and resultant loss of the product that does reach the reactor vessel is inconsequential. Hence, all of the this overcracked gas can be vented out the reactor vessel independent of the main reactor product outlet. As long as the overcracked gases can be recovered separately from the riser products, a wide variety of secondary feedstreams can be injected into the reactor vessel. Consequently, these various secondary feedstreams can react with the large volume of catalyst in the reactor to carry out, under controlled conditions, other slower bimolecular reactions. Examples of such reactions include hydrogen transfer reactions, alkylation and transalkylation reactions. If required, the arrangement of the separation device can isolate the feedstreams from the main FCC product to avoid contamination.

In addition to carrying out a reaction these other feedstreams can benefit the operation of the reactor and regenerator combination by heating the catalyst to improve stripping. The addition of the secondary feed at a relatively high temperature will directly raise the temperature of the catalyst as it enters the stripper. Where the reaction of the secondary feed is exothermic, this reaction will supply additional heat to raise the subsequent temperature in the stripping zone.

Accordingly, in one embodiment, this invention is a process for the fluidized catalytic cracking of an FCC feedstock and conversion of a secondary feedstream. The process comprises passing the FCC feedstock and regenerated catalyst particles to a reactor riser and transporting the catalyst and feedstock upwardly through the riser thereby converting the feedstock to a riser gaseous product stream and producing partially spent catalyst particles by the deposition of coke thereon. The riser discharges a mixture of partially spent catalyst and gaseous products from a discharge end directly into a separation zone and recovers at least 93 wt. % of the riser gaseous products in the separation zone. A first gas outlet withdraws recovered riser gaseous products from the separation zone. Partially spent catalyst and not more than 7 wt. % of the reactor riser gaseous products pass from the separation zone into a reaction vessel wherein a secondary feed contacts the partially spent catalyst particles in the reaction vessel to produce a reactor vessel product stream. A second outlet withdraws the reactor vessel product stream and spent catalyst passes from the reactor vessel into a regeneration zone. Contact of the spent catalyst with a regeneration gas combust coke from the catalyst particles and produces regenerated catalyst particles for transfer to the reactor riser.

In another embodiment, this invention is a process for the fluidized catalytic cracking of an FCC feedstock and the conversion of a secondary feedstream. In the process, FCC feedstock and regenerated catalyst particles pass to a reactor riser which transports the catalyst and feedstock upwardly therethrough converting the feedstock to a riser gaseous product stream and producing partially spent catalyst particles. A riser upwardly discharges the mixture of partially spent catalyst particles and riser gaseous products into a substantially closed disengaging vessel contained within a reactor vessel. Separated catalyst passes downwardly through the disengaging vessel and collects in a first dense catalyst bed contained in the bottom of the disengaging vessel. A stripping medium passes upwardly and contacts the catalyst in the first dense bed. The disengaging vessel discharges partially spent catalyst out of its bottom through a restrictive flow opening. Partially spent catalyst passes downward into the reactor vessel which maintains a second dense bed of catalyst therein. A secondary feedstream passes through the second dense bed of catalyst in the reactor vessel. Contact of the partially spent catalyst with the secondary feedstream produces a reactor vessel product stream. Spent catalyst passes downward from the reactor vessel through a subadjacent stripping vessel through which a stripping medium passes upwardly countercurrently to the flow of the catalyst. Stripped catalyst passes from the stripping vessel into a regeneration zone wherein it is regenerated by contact with an oxygen-containing gas to combust coke from the catalyst particles and provide regenerated catalyst particles for transfer to the reactor riser. A first outlet withdraws riser gaseous products from the disengaging vessel and out of the reactor vessel. A second outlet withdraws reactor vessel product and stripping medium from the reactor vessel.

In a preferred aspect of this invention, the riser gaseous product from the disengaging vessel passes to a cyclone separator that receives less than 10 wt. % of the catalyst entering the disengaging vessel.

In another preferred aspect of this invention the catalyst bed maintained in the disengaging vessel occupies a substantial volume of the disengaging vessel thereby minimizing the dilute phase volume in which overcracking can occur. Catalyst particles passing through the disengaging vessel countercurrently contact a stripping medium.

In another aspect of this invention it has been surprisingly discovered that a traditional ballistic separation device operates with a high separation efficiency in a very restrictive volume. Although unforeseen, there is little reentrainment of catalyst particles with the product gases after the initial separation effected by the ballistic separation. In spite of the restrictive volume, the particle loading on separators that receive the product gas after the initial ballistic separation remains low. Therefore, in this manner, a low volume disengaging vessel that surrounding the discharge end of the ballistic separation riser shortens the catalyst residence time to those usually obtained with closed cyclone separation systems.

Moreover, this invention also reduces the amount of catalyst recovered by the cyclones. As catalyst exits the riser, the disengaging vessel of this invention recovers at least 80 and in most cases over 90% of the catalyst without passing the catalyst through the cyclones. A stripping fluid can contact the catalyst as it passes through the disengaging vessel. This stripping fluid removes the product vapors from the void volume of the catalyst in the dense bed of the disengaging vessel. Since up to 7 vol % of the hydrocarbon vapors leaving the riser can be carried out with the catalyst this stripping of a majority of the catalyst in the restricted volume of the disengaging vessel allow an additional 2 to 4% of the product vapors from the riser to be collected from the disengaging vessel.

Other objects, embodiments and details of this invention are set forth in the following detailed description of the invention.

BRIEF DESCRIPTION OF THE DRAWINGS

FIG. 2 is a slightly modified form of the reactor arrangement shown in FIG. 1.

FIG. 3 is a alternate detail of a vented riser section of FIGS. 1 and 2.

FIG. 4 is an alternate detail for the bottom of a disengaging vessel shown in FIG. 2.

DETAILED DESCRIPTION OF THE INVENTION

Figure 1:
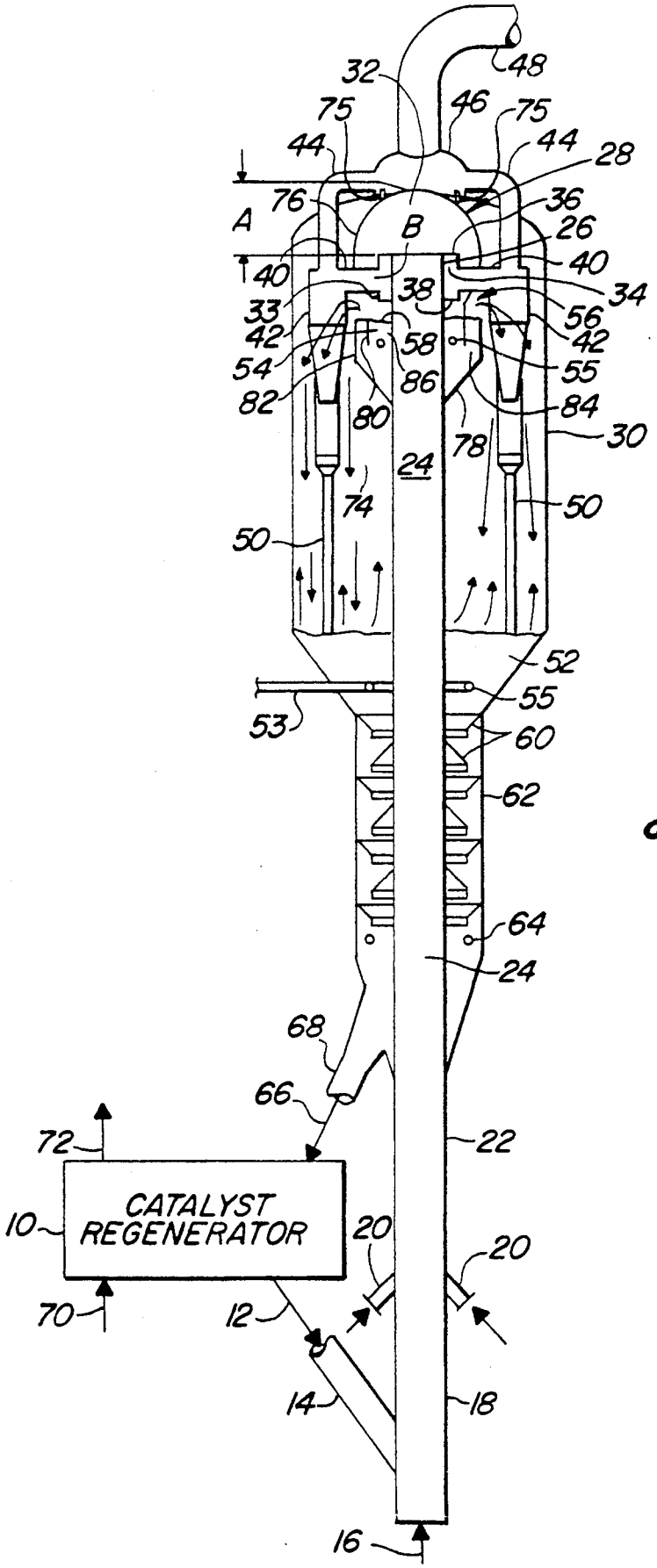
FIG. 1 is a sectional elevation of a reactor having a riser separation device of this invention and a secondary feed inlet, enclosed vented riser of this invention.

This invention relates generally to the reactor side of the FCC process. This invention will be useful for most FCC processes that are used to crack light or heavy FCC feedstocks. The process and apparatus aspects of this invention can be used to modify the operation and arrangement of existing FCC units or in the design of newly constructed FCC units.

This invention uses the same general elements of many FCC units. A reactor riser provides the primary reaction zone. A reactor vessel with a separation device removes catalyst particles from the gaseous product vapors. A stripping zone removes residual sorbed catalyst particles from the surface of the catalyst. Spent catalyst from the stripping zone is regenerated in a regeneration zone having one or more stages of regeneration. Regenerated catalyst from the regeneration zone re-enters in the reactor riser to continue the process. A number of different arrangements can be used for the elements of the reactor and regenerator sections. The description herein of specific reactor and regenerator components is not meant to limit this invention to those details except as specifically set forth in the claims.

An overview of the basic process operation can be best understood with reference to FIG. 1. Regenerated catalyst from a catalyst regenerator 10 (shown schematically) is transferred by a conduit 12, to a Y-section 14. Lift gas injected into the bottom of Y-section 14, by a conduit 16, carries the catalyst upward through a lower riser section 18. Feed is injected into the riser above lower riser section 18 by feed injection nozzles 20.

The mixture of feed, catalyst and lift gas travels up an intermediate section 22 of the riser and into an upper internal riser section 24 that terminates in an upwardly directed outlet end 26. Riser end 26 is located in a separation device in the form of a disengaging vessel 28 which in turn is located in a reactor vessel 30. The gas and catalyst are separated in dilute phase section 32 of the disengaging vessel. The disengaging vessel has substantially closed sidewalls and a substantially closed top. Substantially is defined to mean that the surface is imprevious to fluid passage except for nozzles or passages of relatively small cross section.

In the disengaging vessel type separator of FIG. 1 a collector cup 33 surrounds the outlet end 26 of the riser. Collector cup 33 defines an annular chamber 34 and has an open top 36 and a substantially closed bottom 38. Chamber 34 collects the separated gases from dilute phase 32. The separation device of FIG. 1 also includes a one or more cyclones. Conduits 40 transfer the gas plus a small amount of entrained catalyst to cyclone separators 42. Cyclones 42 swirl the gas and catalyst mixture to separate the heavier catalyst particles from the gas. Conduits 44 withdraw the separated gases from the top of the cyclones 42 and a plenum chamber 46 collects the gases for transfer out of the reactor by overhead conduit 48. Separated catalyst from cyclones 42 drop downward into the reactor through dip legs 50 into a catalyst bed 52.

Catalyst separated in disengaging chamber 28 drops from dilute phase section 32 into a catalyst bed 54. Catalyst bed 54 is preferably maintained as a dense bed which is defined to mean a catalyst bed with a density of at least 20 lbs/ft$^3$. In the most usual arrangements of this invention a stripping medium such as stream will contact the catalyst in the separation device. In the disengaging vessel arrangement steam from a distributor 56 contacts catalyst in the bed 54. Catalyst spills from an opening 56 located in an intermediate section of disengaging vessel 28 at a rate regulated to maintain a catalyst bed level 58. Catalyst from disengaging vessle 28 also collects in the bed 52. A secondary feed enters reactor 30 through a conduit 52 and a distributor 55 disburses the feed over the bottom of bed 52. Reactor vessel 30 has an open volume above catalyst bed 52 that provides a dilute phase section 74. Catalyst cascades downward from bed 52 through a series of frusto-conical baffles 60 that project transversely across the cross-section of a stripping zone in stripper vessel 62. Preferably, stripping zone 62 communicates directly with the bottom of reactor vessel 30 and more preferably as a sub-adjacent location relative thereto. As the catalyst falls, steam or another stripping medium from a distributor 64 rises countercurrently and contacts the catalyst to increase the stripping of adsorbed components from the surface of the catalyst. A conduit 66 conducts stripped catalyst via a nozzle 68 into catalyst regenerator 10. An oxygen-containing gas 70 that enters a catalyst regenerator reacts with coke on the surface of the catalyst to combustively remove coke that is withdrawn from the regenerator as previously described through conduit 12 and produce a flue gas stream comprising the products of coke combustion that exits the regeneration through a line 72.

The countercurrently rising stripping medium desorbs hydrocarbons and other sorbed components from the catalyst surface and pore volume. Stripped hydrocarbons and stripping medium rise through bed 52 and combine with the secondary feed and any resulting products in the dilute phase 74 of reactor vessel 30 to form a reactor vessel product stream. At the top of dilute phase 74 an outlet withdraws the stripping medium and stripped hydrocarbons from the reactor vessel. One method of withdrawing the stripping medium and hydrocarbons is shown in Figure as nozzle 75 which evacuates the reactor vessel product stream from the upper section of dilute phase 74 through the top of reactor vessel 30. The nozzles 75 recover the reactor product stream independently from the riser gaseous products.

The conduit 48, referred to as the reactor vapor line recovers the reactor effluent and transfers the hydrocarbon product vapor of the FCC reaction to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a concentration section for further separation into additional product streams.

The reactor riser used in this invention discharges into a device that performs an initial separation between the catalyst and gaseous components in the riser. The term "gaseous components" includes lift gas, product gases and vapors, and unconverted feed components. The drawing shows this invention being used with a riser arrangement having a lift gas zone 18. A lift gas zone is not a necessity to enjoy the benefits of this invention. Preferably, the end of the riser will terminate with one or more upwardly directed openings that discharge the catalyst and gaseous mixture in an upward direction into a dilute phase section of the disengaging vessel. The open end of the riser can be of an ordinary vented riser design as described in the prior art patents of this application or of any other configuration that provides a substantial separation of catalyst from gaseous material in the dilute phase section of the reactor vessel. Where the separation device at the end of the riser is the disengaging vessel type it is believed to be important that the catalyst is discharged in an upward direction in the disengaging vessel to minimize the distance between the outlet end of the riser and the top of the catalyst bed 54 in the disengaging vessel. The flow regime within the riser will influence the separation at the end of the riser. Typically, the catalyst circulation rate through the riser and the input of feed and any lift gas that enters the riser will produce a flowing density of between 3 lbs/ft$^3$ to 20 lbs/ft$^3$ and an average velocity of about 10 ft/sec to 100 ft/sec for the catalyst and gaseous mixture. The length of the riser will usually be set to provide a residence time of between 0.5 to 10 seconds at these average flow velocity conditions. Other reaction conditions in the riser usually include a temperature of from 920° to 1050° F.

It is not essential to this invention that any particular type of separation device receive the riser effluent. However, what ever type of riser separation device is used, it must achieve a high separation efficiency. The high efficiency restricts the carrythrough of gaseous riser products with the catalyst that enters the reactor vessel. The separation device must separate at least 95 wt. % of the riser gaseous components from the catalyst that returns to the reactor vessel. Since the catalyst usually has a void volume which will retain at least 7 wt. % of the riser gaseous components, some of the riser gaseous components must be displaced from the catalyst void volume to achieve the over 95 wt. % recovery of product components. A preferred manner of displacing riser gaseous components from the catalyst leaving the riser is to maintain a dense catalyst bed adjacent to the riser outlet. This dense bed location minimizes the dilute phase volume of the catalyst and riser products, thereby avoiding the aforementioned problems of prolonged catalyst contact time and overcracking. The dense bed arrangement itself reduces the concentration of riser products in the interstitial void volume to equilibrium levels by passing a displacement fluid therethrough. Maintaining a dense bed and passing a displacement fluid through the bed allows the a complete displacement of the riser gaseous products. Without the dense bed it is difficult to obtain the necessary displacement of gaseous products. Restricting the catalyst velocity through the dense bed also facilitates the displacement of riser gaseous components. the catalyst flux or catalyst velocity through the dense bed should be less than the bubble velocity though the bed. Accordingly the catalyst velocity through the bed should not exceed 1 ft/sec. Protracted contact of the catalyst with the displacement fluid in the dense bed can also desorb additional gaseous riser products from the skeletal pore volume of the catalyst. However, the benefits of increased product recovery must be balanced against the disadvantage of additional residence time for the reactor products in the separation device.

For the disengaging vessel arrangement of FIG. 1, the velocity at which the catalyst and gaseous mixtures discharge from end 26 of the riser also influences the placement of the end of the riser relative to the top of the disengaging vessel. This distance indicated by the letter "A" in FIG. 1 is set on the basis of the flow rate to riser. In the interest of minimizing the dilute volume of catalyst in hte disengaging vessel. distance "A" should be kept as short as possible. Nevertheless, there is need for some space between the end of the riser and the top of the disengagement vessel. Providing a distance as defined by dimension A avoids direct impingement and the resulting erosion of the top of the reactor vessel. Moreover. the discharge of catalyst from the end of the riser requires a space to provide a separation while preventing the re-entrainment of catalyst particles with the gas stream collected by cup 33. Since the reactor riser is usually designed for a narrow range of exit velocities between 20 to 100 ft/sec. distance "A" can be set on the basis of riser diameter. In order to avoid erosion of the upper surface of the reactor vessel and to promote the initial separation of the catalyst from the gaseous components, the distance "A" should equal 5 to 8 riser diameters and preferably less than 3 riser diameters and more preferably less than 2 riser diameters. The avoidance of catalyst re-entrainment after discharge of the riser is influenced by both the riser velocity and the flowing density of the catalyst as it passes downward through the reactor vessel. For most practical ranges of catalyst density in the riser, the distance of 1.5 to 5 riser diameters for dimension "A" is adequate for a flowing catalyst density, often referred to as "catalyst flux", of about 50–200 lb/ft$^2$/sec.

In the disengager vessel type separator the total volume of the vessel is determined by the diameter of the disengager vessel, the distance from the end of the riser to the top of the disengager vessel, dimension "A", and the distance from the discharge end of the riser to the top of the dense bed level in the reactor vessel which is shown as dimension "B" in FIG. 1. In order to minimize re-entrainment of catalyst particles into the any gases that rise from catalyst bed 54, a vertical space must separate riser end 26 and the upper bed level 58. The desired length of this space, represented by dimension B, is primarily influenced by the superficial velocity of the gases that flow upwardly through dense bed 50. A superficial velocity typically below 0.5 ft/sec will minimize the potential for re-entrainment of the gaseous compounds passing through bed 54. The gaseous components passing upward through bed 54 comprise at least hydrocarbons that are desorbed from the surface of the catalyst.

In the disengaging vessel arrangement a stripping or displacement medium enters and passes upwardly out bed 54. The amount of stripping gas entering the typical stripping vessel is usually proportional to the volume of voids in the catalyst. In this invention it is preferred that the amount of stripping gas entering the disengaging vessel be adequate to displace hydrocarbons from the interstitial void area of the catalyst. For most reasonable catalyst to oil ratios in the riser, the amount of stripping gas that must be added to displace the interstitial void volume of the catalyst will be about 1 wt % of the feed. It is essential to the disengager stripper function, also called the pre-stripping, that the catalyst in the bottom of the disengager vessel be maintained as a dense bed. The dense bed minimizes the interstitial voidage of the catalyst. At dense conditions the catalyst bed operates in a bubble phase where gas moves upwardly relative to the catalyst bed. In order to keep gas passing upwardly and out of the bed the downward catalyst in the bed must not exceed the approximately 1 foot per second relative upward velocity of the gas bubbles. Since the removal of the product vapors from the interstitial voids of the catalyst is dependant on equilibrium, a higher steam rate through the dense bed can recover additional amounts of product hydrocarbons from the interstitial as well as the skeletal voids of the catalyst. As more stripping medium enters the disengaging vessel it will provide a more complete stripping function. However, as the addition of stripping medium to the dense bed increase so does the entrainment of catalyst out of the bed and the carry-over of catalyst into the cyclone system shown in FIG. 1. Thus, thorough stripping in the disengager vessel increases the gas flow rate through the disengaging vessel and usually the length of dimension B. Consequently, the benefits of more complete stripping come at the expense of additional dilute phase volume in the disengaging vessel. As long as the superficial velocity of the gases rising through bed 50 stays below 0.5 ft/sec and preferably below about 0.1 ft/sec, a dimension B of 2 feet, and more preferably 4 feet, which roughly equates to 1 to 2 riser diameters, will prevent substantial re-entrainment of the catalyst and the gases exiting the reactor vessel. The primary variable in controlling the superficial gas velocity upward through the dense catalyst bed is the diameter of the disengager vessel. Balancing of a lowered superficial velocity against the disengager volume is again required. Normally the disengager vessel will have a diameter of from 2 to 5 times the riser diameter.

The manner in which the gaseous vapors are withdrawn from the dilute phase volume of the disengager vessel will also influence the initial separation and the degree of re-entrainment that is obtained in the disengager vessel. In order to improve this disengagement and avoid re-entrainment, the Figure shows the use of an annular collector or cup 33 that surrounds the end 26 of the riser. Typically, conduit 40 supports cup 33 from the top of the reactor vessel 30 through cyclones 42 and withdrawal conduits 44. With support from the conduits 40, cup 33 does not contact riser 24. A small annular space between cup 33 and riser 24 allows relative movement between the riser and the cup to accommodate thermal expansion. Conduits 40 are symmetrically spaced around the annular collector 33 and communicate with the annular collector through a number of symmetrically spaced openings to obtain a balanced withdrawal of gaseous components around the entire circumference of the reactor riser. In FIG. 1, cup 33 withdraws all of the stripping medium and gaseous components from the reactor riser disengager stripper and stripper section 62. Cyclones 42 receive all of the withdrawn gases from cup 33.

FIG. 1 shows an arrangement for transferring gases from the conduits 40 to the cyclones that avoids a maldistribution of the catalyst and gas mixture to the different cyclones. The simplest way to connect the conduits 40 with the cyclones is to directly couple one conduit to a corresponding cyclone. This one-to-one arrangement also has the advantage of minimizing the flow path between cup 33 and the cyclones where the final separation of catalyst and gas is performed.

This invention is most effective when only a small amount of the catalyst that enters the process through the riser passes to cyclone separators. While the cyclones can generally provide a good separation between gases and solids, the amount of gases that are carried out of the cyclones with the separated catalyst is relatively high. Therefore, minimizing cyclonic separation of the catalyst and riser gaseous products reduces the amount of riser gaseous products that are carried into the reactor vessel. Preferably any cyclone separators that are used in the method of this invention will receive less than 10 wt. % of the catalyst from the riser.

Whatever type of gas and catalyst separation device is utilized, the catalyst separated therefrom is returned to the process. The catalyst may be returned to any point of the process that puts it back into the circulating inventory of catalyst. The drawing shows the use of conventional cyclones with dip legs 50 returning catalyst near the upper level of dense bed 52. Preferably, the catalyst will be returned to the dense bed in the reactor vessel or stripping vessel.

Catalyst that is initially separated from the gaseous components as it enters the disengager vessel, passes downward through the disengaging vessel as previously described. A gaseous medium, in an amount at least sufficient for fluidization and preferably in an amount to strip the catalyst, passes upward through the catalyst in the disengaging vessel. More preferably the gaseous medium performs stripping of the catalyst as previously described. The disengaging vessel can also include a series of baffles to improve the contact of the catalyst with any stripping gas that passes upwardly through the vessel. However in order to obtain the prestripping advantage as previously described it is essential that a dense bed section is maintained at the top of the disengaging vessel. Such stripping baffles, when provided, can function in the usual manner to cascade catalyst from side to side as it passes through the lower section of the disengager vessel and will be located below a dense bed section in the disengaging vessel.

The composition of the displacement fluid or stripping medium is preferably inert to the product vapors in the separation section. Steam, the usual stripping medium for FCC units, will act as a suitable stripping medium. Where the secondary feed that enters the reactor vessel is compatible with gaseous riser products, a portion of this material may be vented back into the separation system to provide the displacement fluid. Preferably the material that enters the riser separation section will be inert to further reaction with the reactor riser gaseous products and in the presence of the catalyst.

In the embodiment of the invention depicted by FIG. 1, a simple distributor ring 55 adds stripping steam from an external source to the lower section of disengaging vessel 28. Disengaging vessel 28 has an upper shell section 76 and a lower shell section 78. The top of reactor vessel 30 supports upper section 76 of the disengaging vessel. A rigid connection attaches lower section 78 to reactor/riser 24. A lower section 80 of upper section 74 extends into a larger upper portion 82 of lower section 78. A gap between lower portion 80 and upper portion 82 defines an annular chamber 84 having an upper open end that provides opening 56. Opening 56 has a restricted size relative to the cross-section of the disengaging vessel and throttles catalyst out of the disengaging vessel at a controlled rate. The gap between the upper and lower sections of the disengaging vessel permits differential expansion between these sections which are supported from the reactor vessel and riser, respectively. Lower portion 80 together with the outside of riser 24 defines another annular chamber 86. Catalyst flowing out of the disengager passes first through annular chamber 86 and then back up to chamber 84 in a labyrinthine path. The top of upper portion 82 establishes the upper bed level 33 of catalyst bed 54. The restricted opening 56 along with the downward flow of catalyst through annular section 86 and upward through annular section 84 will maintain a catalyst seal between dilute phase 32 and dilute phase 74. Most stripping that occurs in bed 54 takes place between distributor ring 55 and upper bed level 58. Lower wall 80 seals the section and segregates displacement fluid and stripped hydrocarbons from the catalyst flowing out of opening 56. Segregation of the riser gaseous components and displacement medium in the disengaging vessel lowers the concentration of hydrocarbons in the dilute phase 74.

The separation device has a location in an upper portion of the reactor vessel. As shown in FIG. 1, catalyst from the separation device drops downwardly into a dense bed 52 that is maintained in a lower portion of reactor vessel 30. Catalyst collecting in bed 52, although containing a relatively high coke concentration, still has sufficient surface area for catalytic use. Bed 52 supplies a high inventory of catalyst that is available for contact with a number of secondary feeds. The secondary feed enters the lower bed through line 53 and distributor 55 as previously described. Suitable feeds for introduction in this part of the reactor vessel include: hydrotreated heavy naphtha, light cycle oil (LCO) and heavy cycle oil (HCO); light reformate and heavy naphtha either alone or in combination; and light reformate and olefins. The hydrotreated light cycle oils are particularly preferred and are used to carry out'J' cracking type reactions. J-cracking converts light cycle oils and other hydrocarbon steams comprising multi-ring aromatic hydrocarbons that are difficult to crack in a typical FCC process. The 'J' in J-cracking is a measure of unsaturation of the hydrocarbons of the general formula:

$$C_NH_{2N-J}$$

Suitable feedstocks and methods for carrying out J-cracking is further described in U.S. Pat. Nos. 3,479,279 and 3,356,609 which are incorporated herein by reference.

The large volume of the reactor vessel can provide a long contact time for the feed material. After contact with the secondary feed, the catalyst enters a subadjacent stripper.

Stripper 62 operates in the usual manner of FCC strippers. Catalyst passes downward through the stripper in countercurrent contact with the stripping medium that enters the bottom of the stripper and additional intermediate locations where desired.

Improvements in the reduction of product losses and the control of regeneration temperatures have been achieved by providing multiple stages of catalyst stripping and raising the temperature at which the catalyst particles are stripped of products and other combustible compounds. Both of these methods will increase the amount of low molecular weight products that are stripped from the catalyst and will reduce the quantity of combustible material in the regenerator. A variety of arrangements are known for providing multiple stages of stripping and heating the spent catalyst to raise the temperature of the stripping zone. With increasing frequency it is being proposed to raise the temperature of the stripping zone by mixing the spent catalyst with hot regenerated catalyst from the regeneration zone.

In a highly preferred form of this invention, additional heating of the stripping zone can be provided without adding hot catalyst to the reactor vessel or the stripping zone. In order to heat the catalyst, it is preferred that the secondary feed react exothermally in catalyst bed 52. The heat release from the secondary reaction in the catalyst bed will raise the temperature of the catalyst as it enters the stripping zone 62. Hydrogen transfer reactions are the most likely to provide sufficient exothermicity for significantly heating the stripping zone.

The catalyst is withdrawn from the stripping zone and transferred to a regeneration zone. The regenerator receives catalyst withdrawn from the stripping zone and returns regenerated catalyst to the riser for the continuation of the process. Any well-known regenerator arrangement for removing coke from the catalyst particles by the oxidative combustion of coke and returning catalyst particles to the reactor riser can be used. As a result, the particular details of the regeneration zone are not an important aspect of this invention.

Stripped hydrocarbons and stripping medium and reactor vessel products from the dilute phase 74 must flow out of the reactor. FIG. 1 shows outlet 75 in the upper section or reactor vessel 30 for recovering reactor vessel products, stripped hydrocarbons, and stripping medium from the dilute phase 74. Outlets 75 are located at the top of reactor vessel 30 to keep the upper area of the reactor vessel active and prevent coke formation.

The arrangement of this invention may permit the direct recovery of the reactor vessel product from the reactor vessel without the use of a cyclone. In arrangements where only a relatively small amount of gas rises from bed 52, catalyst entrainment may be low enough to recover the reactor vessel product directly from the reactor vessel. If the amount of product and stripping gases is low enough to keep the superficial velocity through the reactor vessel to below 0.2 ft/sec the carry over of catalyst becomes insignificant and no cyclone is needed for the separation of the gases leaving through nozzles 75.

When a large amount of secondary feed passes through the reactor vessel the reactor vessel product will normally pass through a dedicated cyclone separator. The cyclone separator independently withdraws the reactor vessel product from the reactor vessel so that the secondary feed or product does not enter the separation device for recovery of the riser products. The dilute phase 74 can operate at a higher or lower pressure than the internal pressure of the riser separation device. However, a higher pressure in interior of the riser separation device, i.e. dilute phase 74, prevents the transfer of reactor vessel gases into the riser product stream. Nevertheless, of any relative pressure difference between the reactor vessel and the separation device at the end of the riser, in all cases the pressure at the outlet 56 must be higher than the pressure in dilute phase 74 to permit catalyst flow out to the separation device.

A particularly preferred type of secondary feed is a hydrotreated light cycle oil for a J-cracking operation. In this type of operation an FCC feedstock comprising a common middle east vacuum gas oil with an API gravity of 23.4, a UOP K factor of 11.73, a molecular weight of 362, a sulfur content of 2.38 PPM, and boiling point of 650°-1020° F. is contacted with an FCC catalyst in an FCC riser. The FCC riser is part of an FCC unit having a configuration as shown in FIG. 1. Conditions within the riser include a temperature of 920°-1050° F., a pressure of 20 psig, a catalyst to oil ratio of 7, and a contact time of 1 to 6 seconds. Recovery of the converted stream from the reactor vessel through line 48 provides a product having the composition given in Table 1. In the method of this invention up to 100% of the LCO is hydrotreated. Hydrotreating is carried out in the presence of a nickel-molybdenum or cobalt-molybdenum catalyst and relatively mild hydrotreating conditions including a temperature of 600°-700° F., a liquid hourly space velocity (LHSV) of from 0.2 to 2 and a pressure of 500 to 1500 psig. The hydrotreating of the LCO partially saturates bicyclic hydrocarbons such as naphthalene to produce tetralin. Naphthalene has a J factor of 12. In the reaction shown below hydrogenation lowers the J factor to 8 by the conversion of naphthalene to tetralin. The hydrotreated LCO is recycled to the reactor vessel through line 53.

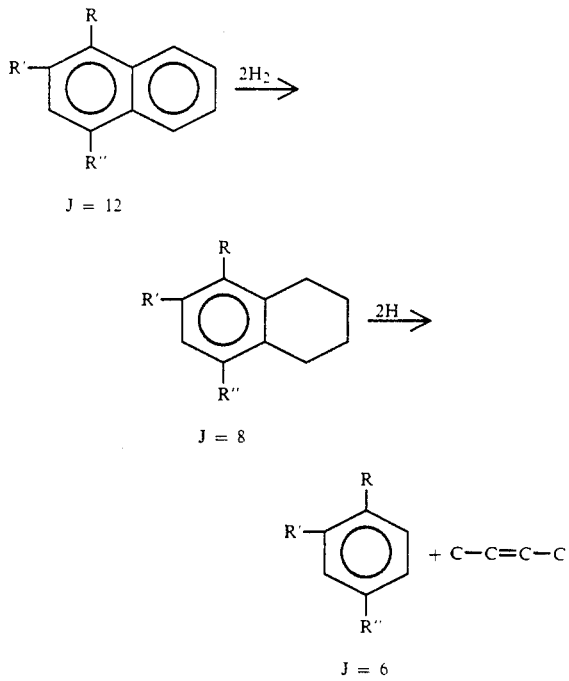

Long contact in the reactor bed for an average time of 2 to 30 seconds and at a temperature of 980°-1020° F.

provides the necessary conditions for cracking of the $J_8$ type hydrocarbons. In the case of tetralin, it principally cracks to a light olefin and a high octane alkyl benzene as shown in the latter stage of the above reaction. The cracked products from the reactor bed are withdrawn through nozzle 75. The combined product from the recovery of the primary product from line 48 and the secondary product from line 75 is described in Table 1. A comparison of the gasoline and J Cracking modes shows a significant increase in the amount of $C_5$ gasoline that is produced and a higher overall octane for the J Cracking gasoline.

TABLE 1

| | Gasoline Mode | 'J' Cracking Mode |
|---|---|---|
| $C_2$ wt. % | 3.16 | 3.47 |
| $C_3/C_4$ lv. % | 10.7/15/4 | 11.94/17.24 |
| $C_5$ Gasoline lv. % | 60.0 | 65.1 |
| LCO lv. % | 13.9 | 5.7 |
| CO lv. % | 9.2 | 9.9 |
| Coke | 5.0 | 5.47 |
| RON/MON | 93.2/80.4 | 93.5/80.9 |
| Conv. lv. % | 76.9 | 84.4 |
| Total lv. % | 109.2 | 110.0 |

FIG. 2 shows alternate details for the disengaging vessel type separation device 92, riser 74' and cup 33 that surrounds the riser. In FIG. 2, a disengaging vessel 92 has an upper section 90 and a sleeve 88 surrounds the upper end of upper section 90. Again disengaging vessel 90 is closed relative reactor vessel 30', except for the 56'. A secondary feed enters the reactor vessel through a line 52' and distributor 55'. A cyclone inlet 91 draws the reactor vessel product into a cyclone 93 which separates catalyst from the reactor vessel product. The reactor vessel product leaves the cyclone and reactor vessel through a conduit 95 and a dip pipe 97 returns catalyst from cyclone 93 to bed 52'. Cup 33' surrounds riser end 26'.

FIG. 2 also shows that the riser end 26' need not end at the outlet of cup 33'. Riser end 26' can extend above the cup 33' as shown in FIG. 2. Alternately, a riser end 26'' can stop below the top of a cup 33'' as shown in FIG. 3. Placement of the riser end relative to the end of the cup affects the separation efficiency of a catalyst and gas leaving the riser. For the purposes of this invention, the riser end will usually have a location two to three feet from the top of the cup.

FIG. 2 illustrates a slightly different form for the lower disengaging vessel section 96 with a slightly different form than that shown in FIG. 1. Again, catalyst flows downward and upwardly around a lower portion of the upper disengaging vessel section and out over the top of lower disengaging vessel section 96. As mentioned, fluidizing medium is distributed near the bottom of the disengaging vessel and an adequate seal is maintained between a dilute phase 32' and a dilute phase 74' while still permitting catalyst to overflow the outside of section 96 and flow out of the disengaging vessel.

FIG. 4 illustrates a preferred arrangement for an overflow and seal device at the bottom of the disengaging vessel. A lower cylindrical portion 98 of a disengaging vessel extends into a lower section 100 of a disengaging vessel. Lower section 98 defines an inner catalyst flow space 102 between its inside surface and the outer wall of a riser 24'' and an outer catalyst flow path 104 between the outside of lower portion 98 and a cylindrical wall 106 of lower disengaging section 100. A distributor ring 108 extends around the reactor riser and distributes the stripping medium to flow space 102. Catalyst flows from passage 102 to 104 along a downward inclined bottom 108 of disengaging vessel section 100. Slots 110 in the wall of 106 discharge catalyst from the bottom of disengaging section 100. Sizing of slots 110 holds catalyst in the passage 102. An overflow pipe 112 having an opening 114 at a level above the top of slots 110 and the bottom of wall portion 98 limits the height of catalyst in passages 102 and 104. Inlet 114 is located below the top of lower disengaging vessel section 100. Catalyst in excess of that retained in the volume below inlet 114 flows over into pipe 112, past a deflector 116 at the bottom of pipe 112 and down to the catalyst bed in the bottom of the reactor vessel. This overflow device has the advantage of improving the control of the overall catalyst flow and level stability within the disengaging vessel.

The foregoing description sets forth essential features of this invention which can be adapted to a variety of applications and arrangements without departing from the scope and spirit of the claims hereafter presented.

We claim:

1. A process for the fluidized catalytic cracking (FCC) of an FCC feedstock and conversion of a secondary feedstream, said process comprising:

a) passing said FCC feedstock and regenerated catalyst particles to a reactor riser and transporting said catalyst and feedstock upwardly through said riser thereby converting said feedstock to a riser gaseous product stream and producing partially spent catalyst particles by the deposition of coke on said regenerated catalyst particles;

b) discharging a mixture of partially spent catalyst particles and gaseous products from a discharge end of said riser directly into a substantially closed separation zone contained within a reaction vessel and recovering at least 95 wt % of the riser gaseous products from said riser in said separation zone;

c) withdrawing said recovered riser gaseous products from said substantially closed separation zone through a first gas outlet;

d) passing said partially spent catalyst and not more than 5 wt. % of the reactor riser gaseous products downwardly from said separation zone into said reaction vessel and contacting a secondary feed with said partially spent catalyst in said reaction vessel to produce a reactor vessel product stream;

e) withdrawing said reactor vessel product stream from said reactor vessel through a second outlet; and, f) passing spent catalyst from said reactor vessel into a regeneration zone and contacting said spent catalyst with a regeneration gas in said regeneration zone to combust coke from said catalyst particles and produce regenerated catalyst particles for transfer to said reactor riser.

2. The process of claim 1 wherein a dense bed of said partially spent catalyst is maintained in the bottom of said reactor vessel and said secondary feed is injected into the bottom of said stripping zone.

3. The process of claim 1 wherein a stripping zone is located subadjacent to said reactor vessel, said catalyst is passed from said reactor vessel to said stripping zone, a stripping fluid is passed upwardly through said stripping zone and said spent catalyst is transferred from said stripping zone to said regeneration vessel.

4. The process of claim 1 wherein said separation zone comprises a disengaging zone, said riser extends into said separation zone, said partially spent catalyst and said riser gaseous products are discharged directly into said disengaging vessel.

5. The process of claim 4 wherein said disengaging zone includes a cyclone separator and said cyclone separator receives less than 10 wt. % of the catalyst exiting said riser.

6. The process of claim 1 wherein a dense bed of said partially spent catalyst is maintained in said stripping zone and a stripping medium passes upwardly through said dense bed of catalyst and is withdrawn with said riser gaseous products.

7. The process of claim 6 wherein said separation zone includes a riser disengaging zone, said riser has an open discharge end that upwardly discharges said spent catalyst and said riser gaseous products into a disengaging vessel, riser gaseous products and not more than 10 wt % of the catalyst entering the riser is transferred from said disengaging vessel to a cyclone separator, said riser gaseous products are withdrawn from said cyclone separator through said first outlet, and partially spent catalyst from said cyclone separator is discharged into said reactor vessel.

8. The process of claim 1 wherein said secondary feed comprises bicyclic hydrocarbons having a J factor of about 8.

9. The process of claim 1 wherein a portion of said reactor vessel product stream is transferred to said separation zone for displacing said riser gaseous products from the catalyst in said separation zone.

10. The process of claim 1 wherein, said separation zone has an interior volume maintained at a first pressure and the interior of said reactor vessel is maintained at a second pressure that is lower than said first pressure.

11. A process for the fluidized catalytic cracking (FCC) of an FCC feedstock and conversion of a secondary feedstream, said process comprising:

a) passing said FCC feedstock and regenerated catalyst particles to a reactor riser and transporting said catalyst and feedstock upwardly through said riser thereby converting said feedstock to a riser gaseous product stream and producing partially spent catalyst particles by the deposition of coke on said regenerated catalyst particles;

b) discharging a mixture of partially spent catalyst particles and riser gaseous products from a discharge end of said riser in an upward direction into a substantially closed disengaging vessel contained in a reactor vessel;

c) passing separated catalyst downward through said disengaging vessel and collecting catalyst in a first dense catalyst bed contained within said disengaging vessel and contacting said catalyst with a stripping medium in said first dense bed;

d) discharging partially spent catalyst out of the bottom of said disengaging vessel through a restricted flow opening;

e) passing said partially spent catalyst downward from said disengaging vessel into said reactor vessel and maintaining a second dense catalyst bed in said reactor vessel and introducing a secondary feedstock into said second dense catalyst bed;

f) contacting said partially spent catalyst with said secondary feedstock in said dense bed to produce a reactor vessel product stream;

g) passing spent catalyst from said reactor vessel downward through a subadjacent stripping vessel and passing a stripping medium upwardly through said stripping vessel countercurrently to the flow of said catalyst;

h) withdrawing stripped catalyst from said stripping vessel and passing stripped catalyst from said stripping vessel into a regeneration zone and contacting said stripped catalyst with a regeneration gas in said regeneration zone to combust coke from said catalyst particles and produce regenerated catalyst particles for transfer to said reactor riser;

i) withdrawing said riser gaseous products from said disengaging vessel and removing said riser product stream from said disengaging vessel through a first outlet; and, j) withdrawing said reactor vessel product and stripping medium from said reactor vessel through a second outlet.

12. The process of claim 11 wherein catalyst is discharged out of the bottom of said disengaging vessel through a sealing arrangement.

13. The process of claim 12 wherein said stripping medium comprises said reactor vessel product.

14. The process of claim 12 wherein said disengaging vessel includes an upper and a lower section, said sealing arrangement includes a labyrinthine path wherein the catalyst exiting said disengaging vessel flows downward through an inner annular space between said riser and a lower end of said upper section past the lower end of said lower section and upward through an outer annular space located between said upper section and said lower section.

15. The process of claim 14 wherein catalyst flows out of said outer annular space through an opening in the outer wall of said lower section and through a catalyst conduit having an upper end for receiving catalyst located in said outer annular space below the upper end of said lower section.

16. The process of claim 11 wherein said disengaging vessel is operated at a lower pressure than said reactor vessel.

17. The process of claim 11 wherein at least 90% of the catalyst leaving said riser passes through said dense catalyst bed of said disengaging vessel.

18. The process of claim 11 wherein said catalyst is throttled through said dense catalyst bed at a velocity of less than 1 ft/sec.

19. The process of claim 18 wherein not more than 5 wt % of said riser gaseous products enter said reactor vessel.

20. The process of claim 11 wherein said stripping medium comprises steam.

21. A process for the fluidized catalytic cracking (FCC) of an FCC feedstock and conversion of a secondary feedstock, said process comprising:

a) passing said FCC feedstock and regenerated catalyst particles to a reactor riser and transporting said catalyst and feedstock upwardly through said riser thereby converting said feedstock to a gaseous product stream and producing spent catalyst particles by the deposition of coke on said regenerated catalyst particles;

b) discharging a mixture of partially spent catalyst particles and riser gaseous products from a discharge end of said riser in an upward direction into a disengaging vessel contained in a reactor vessel, said disengaging vessel having substantially closed sidewalls and a substantially closed top, thereby providing an initial separation of the spent catalyst from the gaseous products;

c) passing separated catalyst downward through said disengaging vessel and collecting catalyst in a first dense catalyst bed located in said disengaging vessel;

d) passing a first stripping medium into a lower section of said disengaging vessel and passing said stripping medium countercurrently through said dense bed to riser gaseous products from said catalyst and producing a first stripping fluid comprising stripping medium and riser gaseous products;

e) discharging at least 90 wt. % of said partially spent catalyst out of the bottom of said disengaging vessel through a sealing device;

f) passing said spent catalyst downward from said sealing device into a second dense catalyst bed maintained in the bottom of said reactor vessel and charging a secondary feedstream to said second dense catalyst bed;

g) contacting said secondary feedstream with said partially spent catalyst in said second dense catalyst bed to produce a reactor vessel product;

h) passing catalyst from said second dense catalyst bed into a subadjacent stripping vessel, said stripping vessel having open communication with a lower end of said reactor vessel, countercurrently contacting said spent catalyst with a second stripping medium in said dense catalyst bed and upwardly discharging a second stripping fluid comprising stripping medium and said reactor vessel product from said stripping zone;

i) passing spent catalyst from said subadjacent stripping vessel into a regeneration zone and contacting said spent catalyst with a regeneration gas in said regeneration zone to combust coke from said catalyst particles and produce regenerated catalyst particles for transfer to said reactor riser;

j) collecting a first effluent stream comprising said first stripping fluid in an annular chamber located in said disengaging vessel, said annular chamber surrounding the end of the said riser and having a substantially closed bottom and an open top located below the discharge end of said riser;

k) transferring said first effluent stream in an enclosed conduit from said annular chamber to a cyclone separator located in said reactor vessel outside of the disengager vessel and separating entrained catalyst from said effluent stream;

l) discharging separated catalyst from said cyclone separator into said second stripping zone;

m) recovering said first effluent from said cyclone separator through a first outlet; and, n) withdrawing said second stripping fluid from said the open volume of said reactor vessel as a second effluent through a second outlet.

* * * * *